US008378913B2

(12) United States Patent
Tao et al.

(10) Patent No.: US 8,378,913 B2
(45) Date of Patent: Feb. 19, 2013

(54) DUAL-BAND ANTENNA UNIT

(75) Inventors: Wen-Szu Tao, Hsinchu (TW); Sy-Been Wang, Hsinchu County (TW)

(73) Assignee: Arcadyan Technology Corporation, Hsinchu (TW)

( * ) Notice: Subject to any disclaimer, the term of this patent is extended or adjusted under 35 U.S.C. 154(b) by 323 days.

(21) Appl. No.: 12/967,173

(22) Filed: Dec. 14, 2010

(65) Prior Publication Data

US 2011/0140989 A1 Jun. 16, 2011

(30) Foreign Application Priority Data

Dec. 15, 2009 (TW) ..... 98142878 A

(51) Int. Cl.
*H01Q 9/04* (2006.01)

(52) U.S. Cl. ..... 343/790; 343/791

(58) Field of Classification Search ..... 343/790, 343/791, 792, 893
See application file for complete search history.

(56) References Cited

U.S. PATENT DOCUMENTS 6,836,256 B2 * 12/2004 Hung ..... 343/790
6,947,006 B2 * 9/2005 Diximus et al. ..... 343/790
7,064,728 B1 * 6/2006 Lin et al. ..... 343/792

* cited by examiner

*Primary Examiner* — Tan Ho
(74) *Attorney, Agent, or Firm* — Morris Manning & Martin LLP; Tim Tingkang Xia, Esq.

(57) ABSTRACT

A dual-band antenna unit, comprising: a first radiation unit; a second radiation unit; a first signal feed-in unit electrically connected to the first radiation unit; and a second signal feed-in unit, electrically connected to the second radiation unit; wherein the first radiation unit, the second radiation unit, the first signal feed-in unit and the second signal feed-in unit are disposed in the dual-band antenna unit. Therefore, the number of antennas can be reduced to achieve lower cost while remaining the signal transmission quality.

17 Claims, 21 Drawing Sheets

DUAL-BAND ANTENNA UNIT

ROSS-REFERENCE TO RELATED APPLICATIONS

This non-provisional application claims priority under 35 U.S.C. §119(a) on Patent Application No(s). 098142878 filed in Taiwan, R.O.C. on Dec. 15, 2009, the entire contents of which are hereby incorporated by reference.

BACKGROUND OF THE INVENTION

1. Field of the Invention

The present invention generally relates to a dual-band antenna unit and, more particularly, to a dual-band antenna unit comprising a plurality of antennas with various frequency bands with excellent signal transmission quality.

2. Description of the Prior Art

The currently available wireless products, such as wireless network base stations, have to provide 11b/g and 11a antennas with various frequency bands. Therefore, at least two antennas (each for one frequency band) are required to meet the requirement, which leads to difficulty in product design.

Therefore, there exists a need in providing a dual-band antenna unit so that the number of antennas can be reduced to achieve lower cost while remaining the signal transmission quality.

SUMMARY OF THE INVENTION

It is one object of the present invention to provide a dual-band antenna unit to reduce the number of antennas to achieve lower cost while remaining the signal transmission quality.

In order to achieve the foregoing object, the present invention provides a dual-band antenna unit, comprising: a first radiation unit; a second radiation unit; a first signal feed-in unit being electrically connected to the first radiation unit; and a second signal feed-in unit being electrically connected to the second radiation unit; wherein the first radiation unit, the second radiation unit, the first signal feed-in unit and the second signal feed-in unit are disposed in the dual-band antenna unit.

Preferably, the first radiation unit comprises a first metal tube and a second metal tube electrically connected in series, wherein the first signal feed-in unit is electrically connected to the first metal tube and the second metal tube.

Preferably, the first signal feed-in unit comprises a first feed-in unit and a first grounding unit, the first grounding unit being electrically connected to the first metal tube and the first feed-in unit being electrically connected to the second metal tube.

Preferably, the second radiation unit comprises a third metal tube and a first metal wire electrically connected in series, wherein the second signal feed-in unit is electrically connected to the third metal tube and the first metal wire.

Preferably, the second signal feed-in unit further comprises a second feed-in unit and a second grounding unit, the second grounding unit being electrically connected to the third metal tube and the second feed-in unit being electrically connected to the first metal wire.

Preferably, the first metal wire is extended from the second feed-in unit.

Preferably, the first radiation unit comprises a first metal tube and a second metal wire electrically connected in series, wherein the first signal feed-in unit is electrically connected to the first metal tube and the second metal wire.

Preferably, the first signal feed-in unit further comprises a first feed-in unit and a first grounding unit, the first grounding unit being electrically connected to the first metal tube and the first feed-in unit being electrically connected to the second metal wire.

Preferably, the second metal wire is extended from the first feed-in unit.

Preferably, the first signal feed-in unit and the second signal feed-in unit are co-axial wires.

Preferably, the present invention further comprises a housing so that the first radiation unit, the second radiation unit, the first signal feed-in unit and the second signal feed-in unit are disposed in the dual-band antenna unit.

Preferably, the first radiation unit and the second radiation unit are arranged in series in the housing.

Preferably, the housing is made of plastic.

Preferably, the first metal tube, the second metal tube and the third metal tube are copper tubes.

Preferably, the first metal wire is a copper wire.

Preferably, the second metal wire is a copper wire.

Accordingly, the number of antennas can be reduced to achieve lower manufacturing cost while remaining the signal transmission quality.

BRIEF DESCRIPTION OF THE DRAWINGS

The objects, spirits and advantages of the embodiments of the present invention will be readily understood by the accompanying drawings and detailed descriptions, wherein.

DETAILED DESCRIPTION OF THE PREFERRED EMBODIMENT

The present invention can be exemplified by the embodiment as described hereinafter.

Figure 1A:
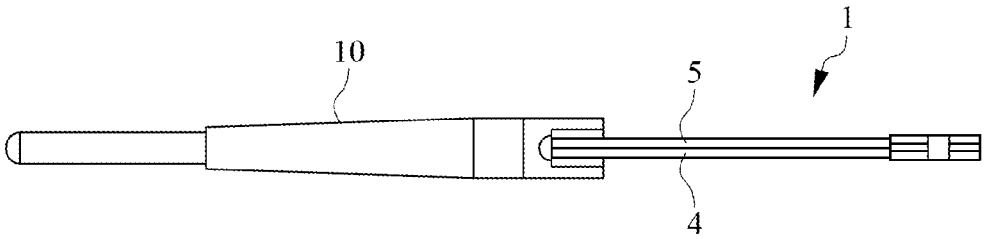
FIG. 1A is a front view of a dual-band antenna unit according to one embodiment of the present invention.
Figure 1B:
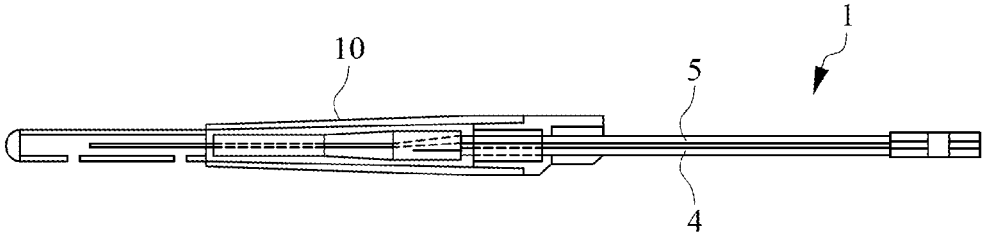
FIG. 1B is a perspective view of a dual-band antenna unit according to one embodiment of the present invention.
Figure 1C:
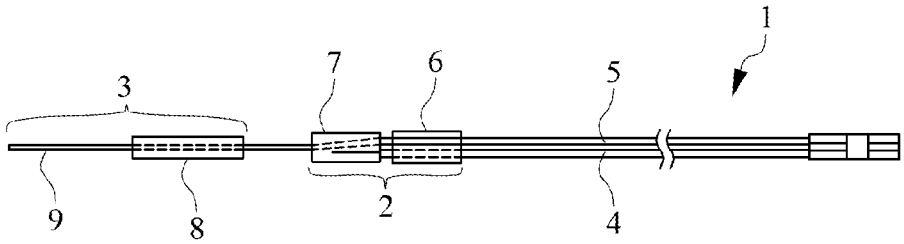
FIG. 1C is a structural view of a dual-band antenna unit according to one embodiment of the present invention.

FIG. 1A, FIG. 1B and FIG. 1C are respectively a front view, a perspective view and a structural view of a dual-band antenna unit according to one embodiment of the present invention. Referring to FIG. 1A, FIG. 1B and FIG. 1C, the present invention provides a dual-band antenna unit 1, comprising: a first radiation unit 2 comprising a first metal tube 6 and a second metal tube 7 electrically connected in series; a second radiation unit 3 comprising a third metal tube 8 and a first metal wire 9 electrically connected in series; a first signal feed-in unit 4 comprising a first feed-in unit and a first grounding unit, the first grounding unit being electrically connected to the first metal tube 6 and the first feed-in unit being electrically connected to the second metal tube 7; and a second signal feed-in unit 5 comprising a second feed-in unit and a second grounding unit, the second grounding unit being electrically connected to the third metal tube 8 and the second feed-in unit being electrically connected to the first metal wire 9; wherein the first radiation unit 2, the second radiation unit 3, the first signal feed-in unit 4 and the second signal feed-in unit 5 are disposed in the dual-band antenna unit 1.

According to the present embodiment, the first metal wire 9 is extended from the second feed-in unit. Preferably, the first signal feed-in unit 4 and the second signal feed-in unit 5 are co-axial wires. Generally, to avoid interference from external signals, the dual-band antenna unit 1 further comprises a housing 10 so that the first radiation unit 2, the second radiation unit 3, the first signal feed-in unit 4 and the second signal feed-in unit 5 are disposed in the dual-band antenna unit 1. In this manner, the performance of the dual-band antenna unit 1 is improved. Preferably, the first radiation unit 2 and the second radiation unit 3 are arranged in series in the housing 10. The housing 10 is made of non-conductive materials such as plastic capable of protecting the radiation units. To fixedly install the elements in the dual-band antenna unit 1, a plastic coating can be provided to cover the first radiation unit 2 and the second radiation unit 3. The materials for making the first metal tube 6, the third metal tube 8, the second metal tube 7 and the first metal wire 9 are not limited to the examples in present embodiment. Generally, these elements can be made of copper.

Figure 2A:
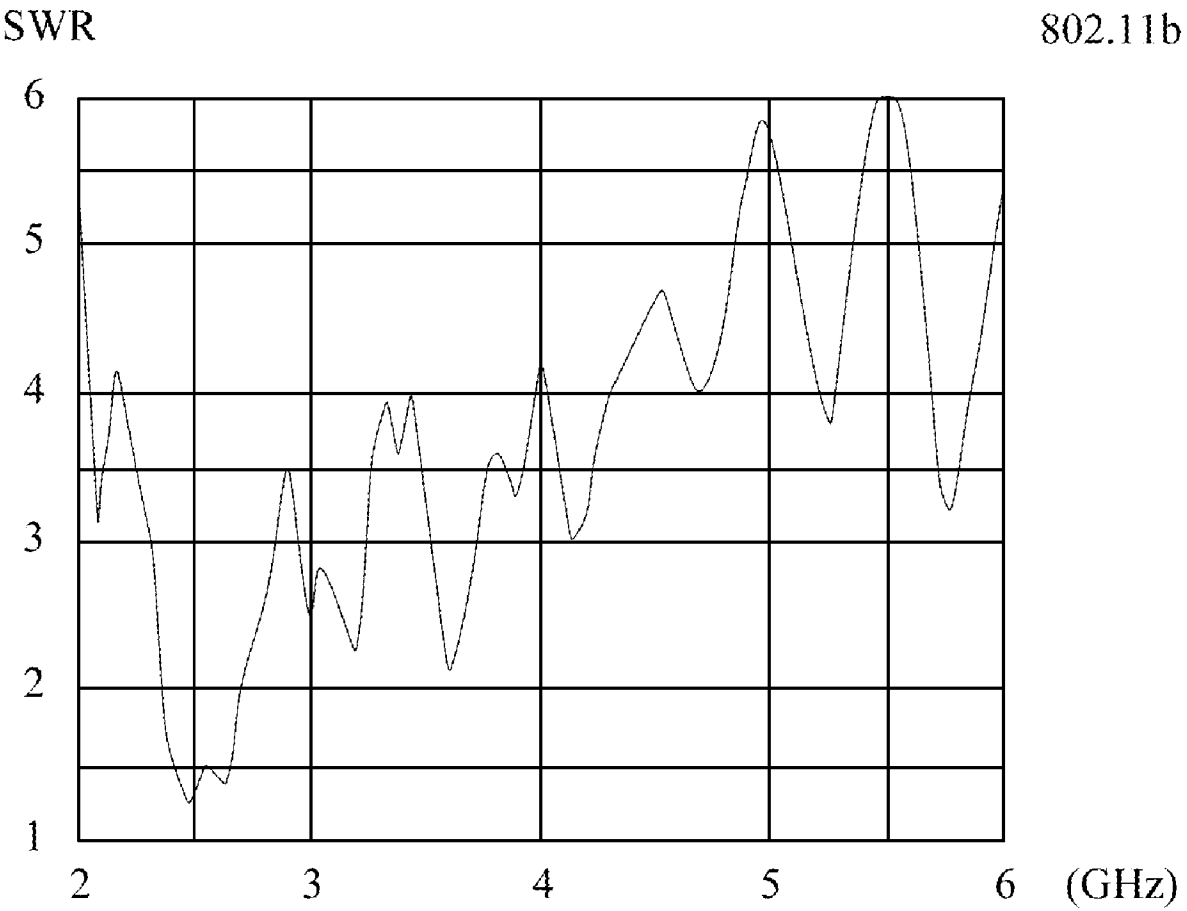
FIG. 2A shows the relation of standing-wave ratio (SWR) to frequency based on 802.11b according to one embodiment of the present invention.
Figure 2B:
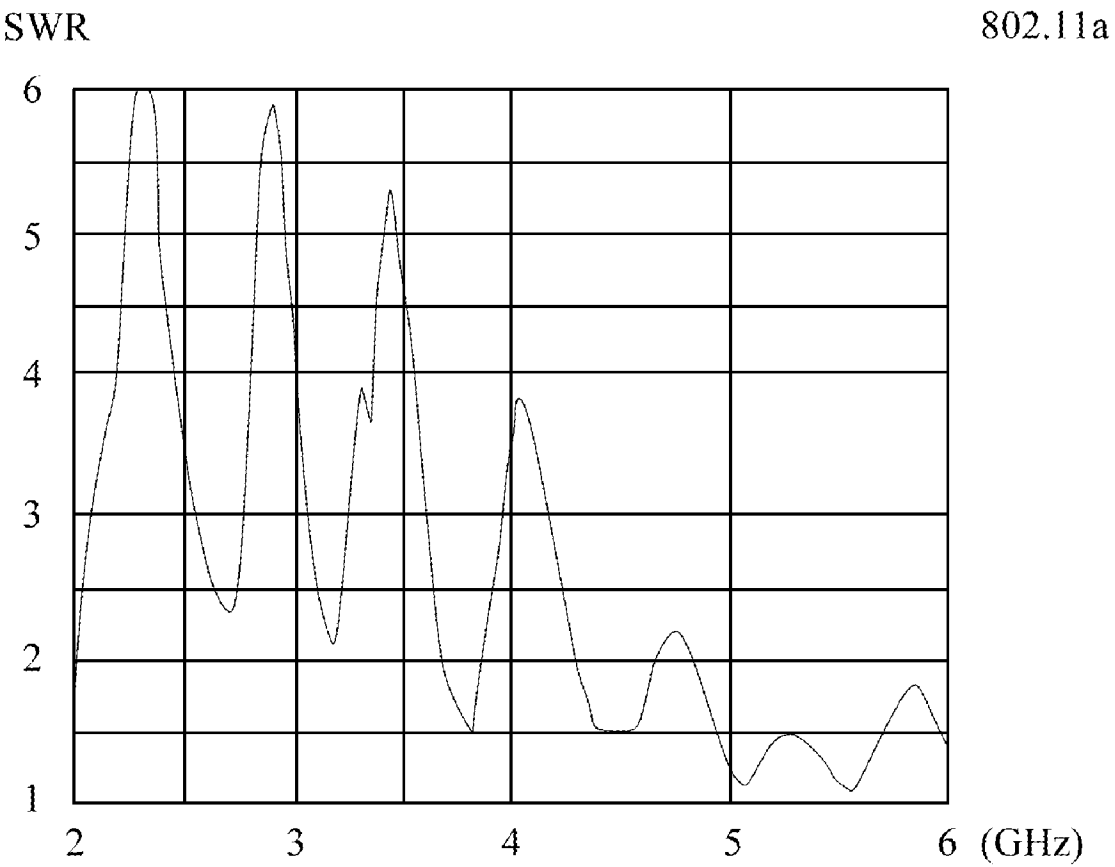
FIG. 2B shows the relation of standing-wave ratio (SWR) to frequency based on 802.11a according to one embodiment of the present invention.
Figure 2C:
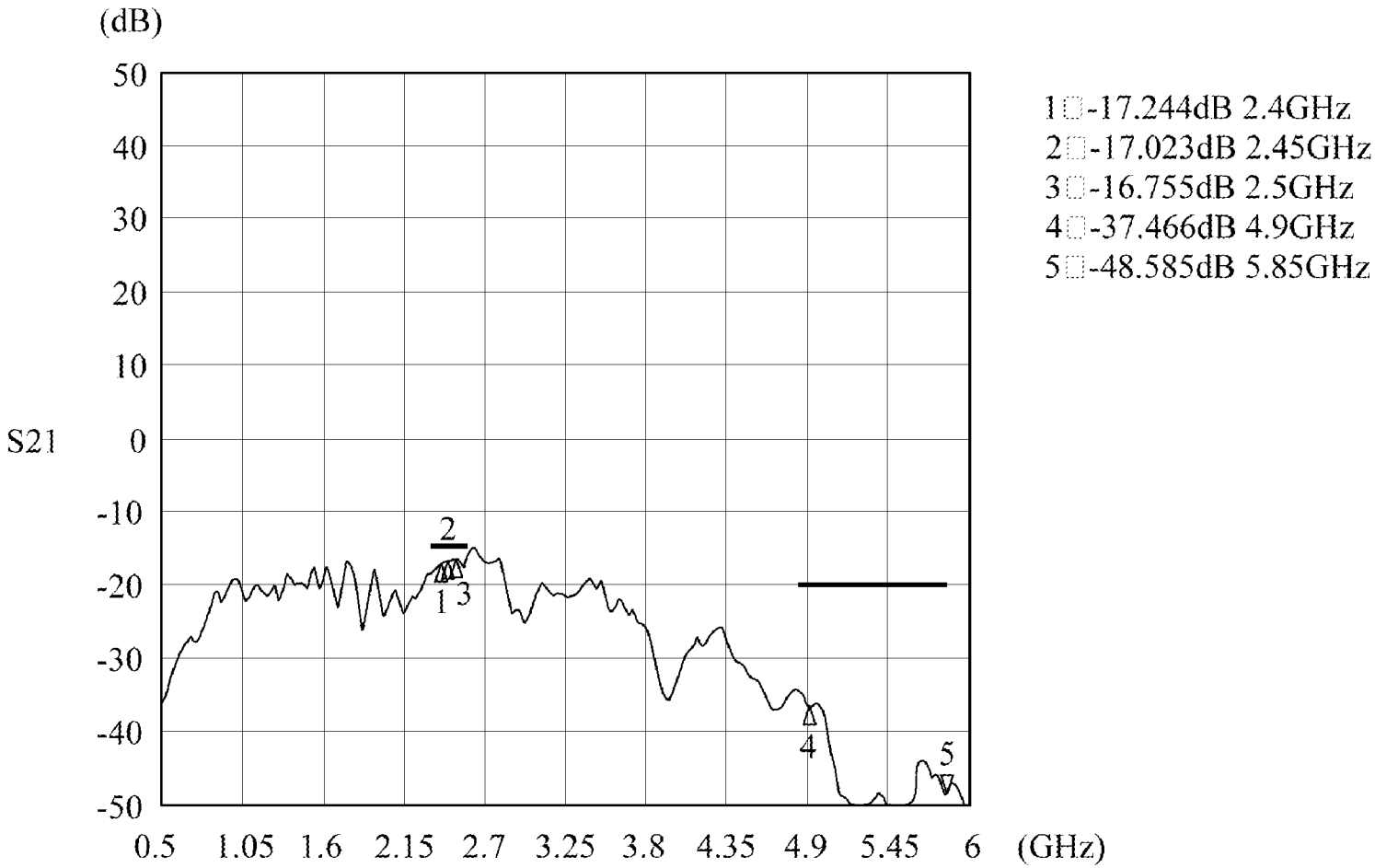
FIG. 2C shows the relation of S21 to frequency according to one embodiment of the present invention.
Figure 3A:
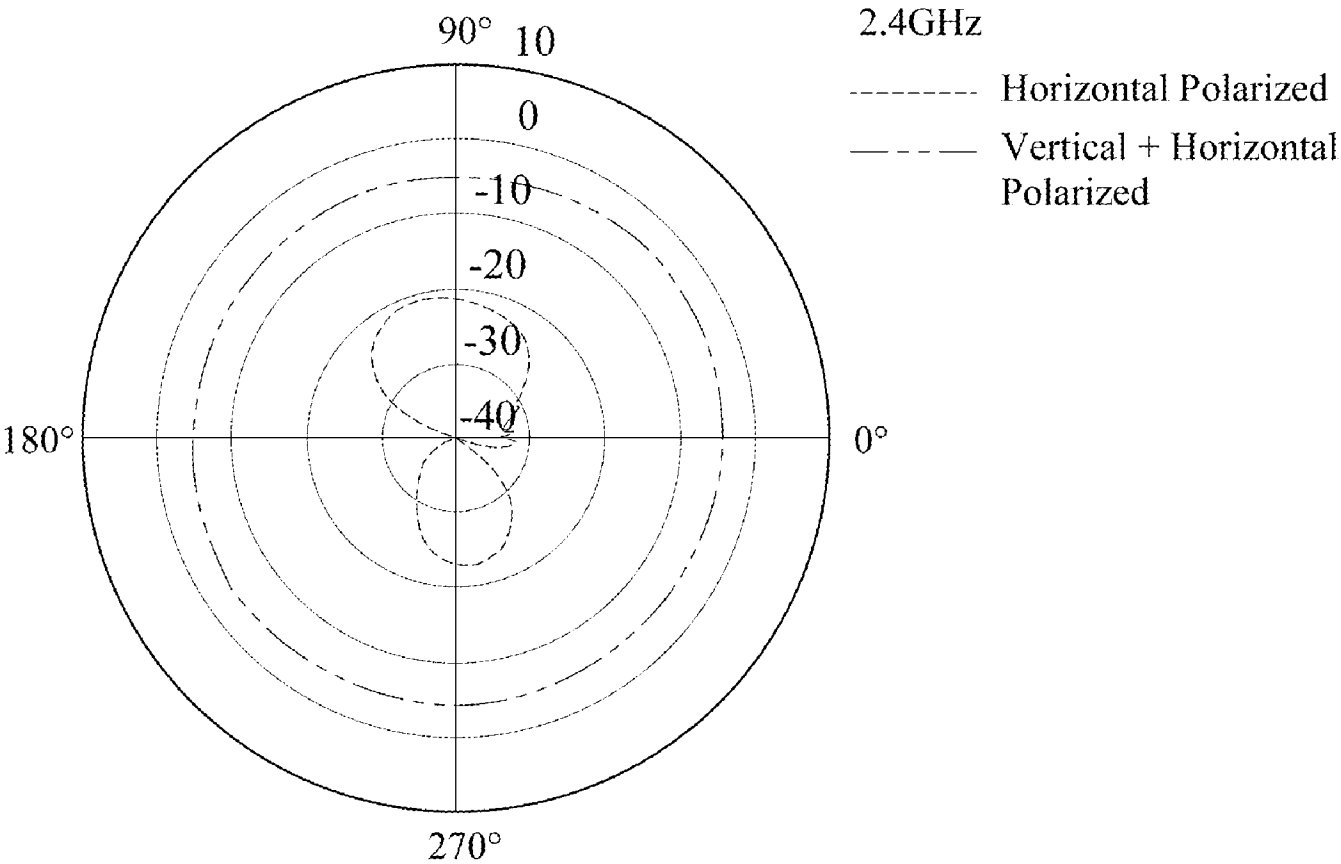
FIG. 3A shows the field pattern of a dual-band antenna unit at 2.4 GHz according to one embodiment of the present invention.
Figure 3B:
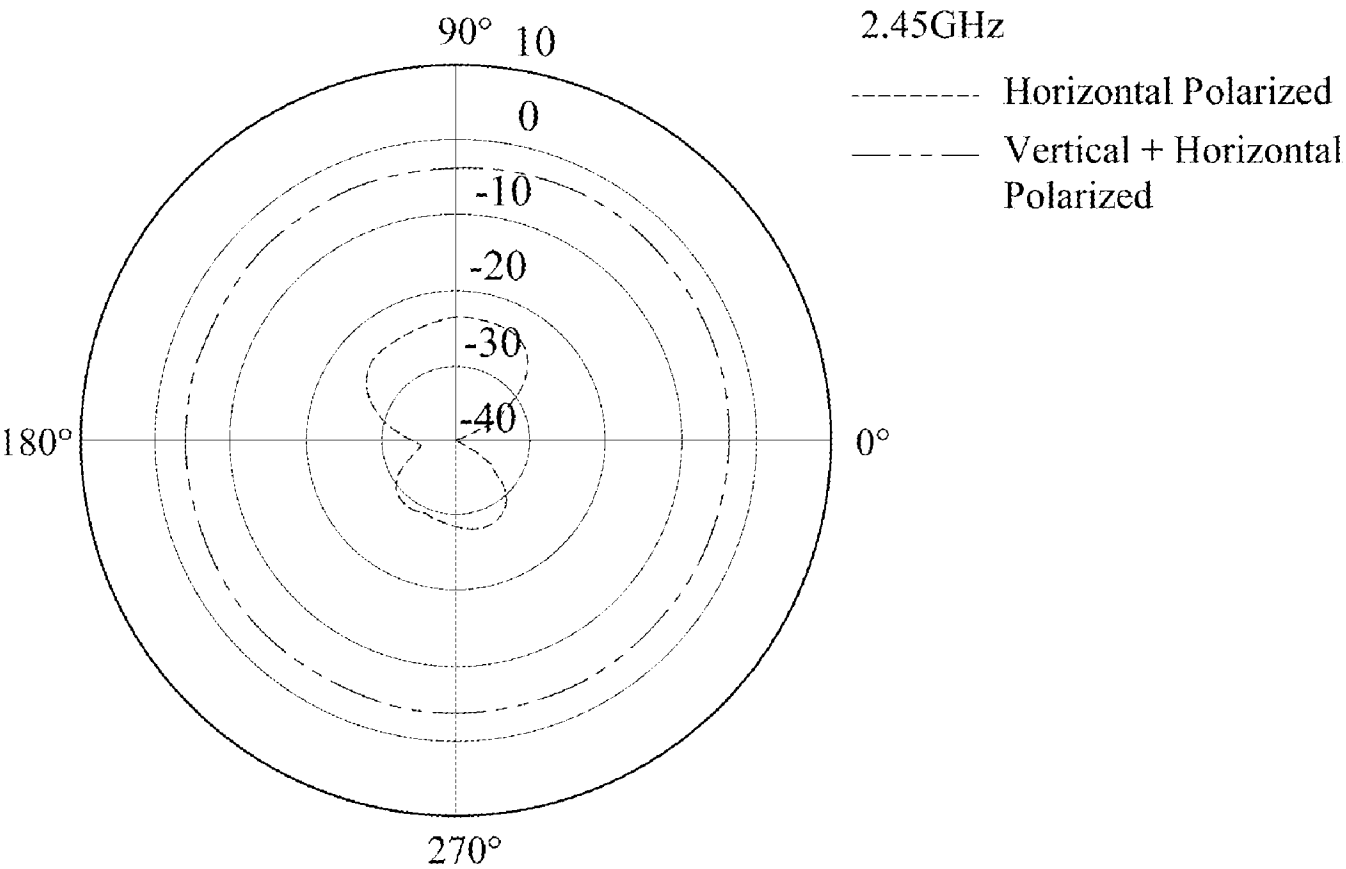
FIG. 3B shows the field pattern of a dual-band antenna unit at 2.45 GHz according to one embodiment of the present invention.
Figure 3C:
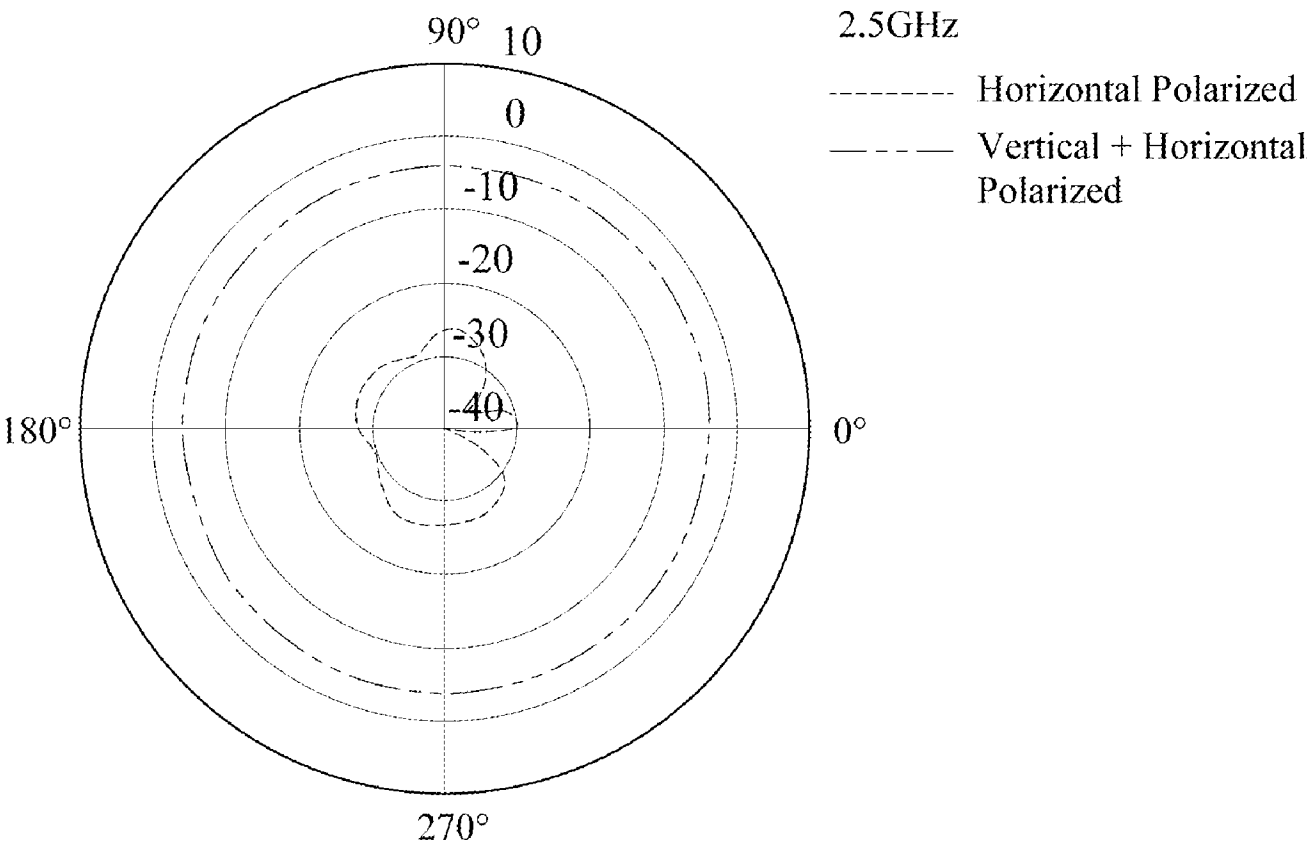
FIG. 3C shows the field pattern of a dual-band antenna unit at 2.5 GHz according to one embodiment of the present invention.
Figure 3D:
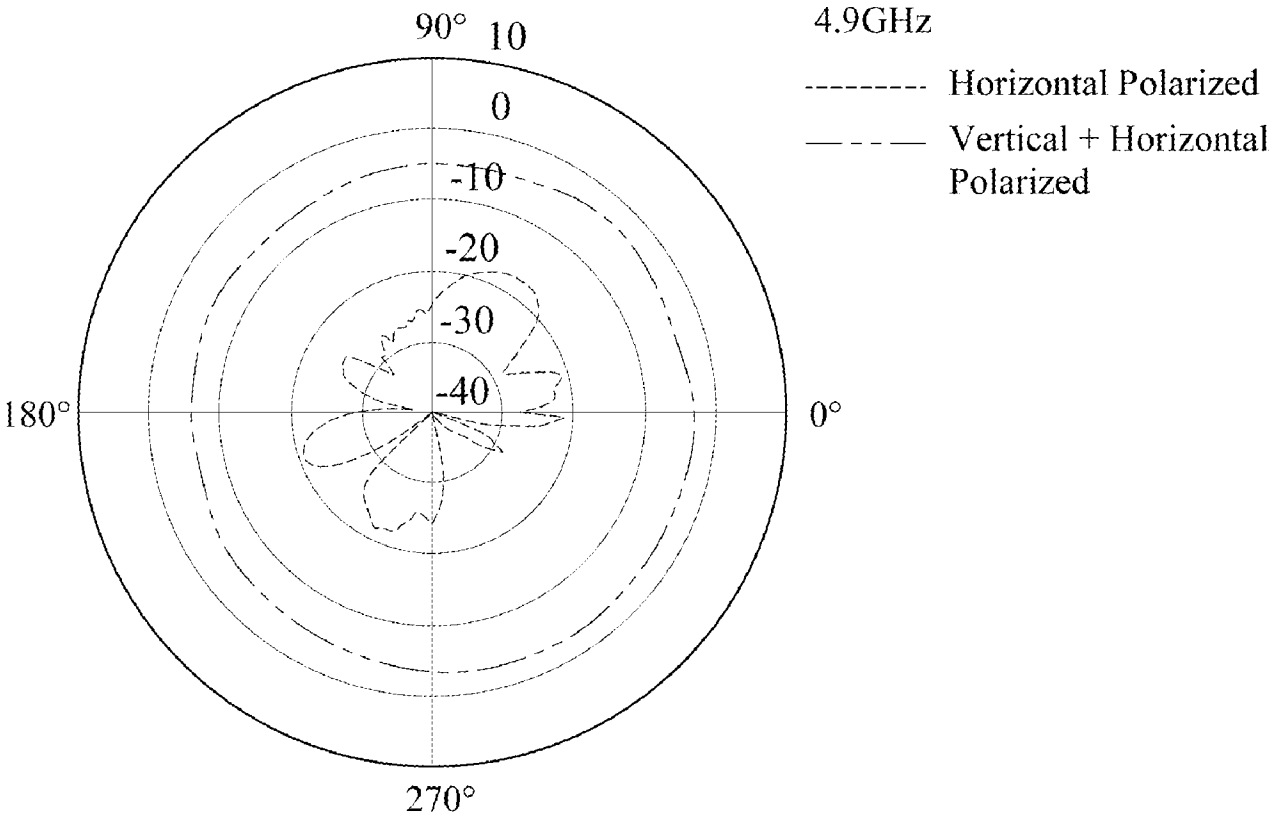
FIG. 3D shows the field pattern of a dual-band antenna unit at 4.9 GHz according to one embodiment of the present invention.
Figure 3E:
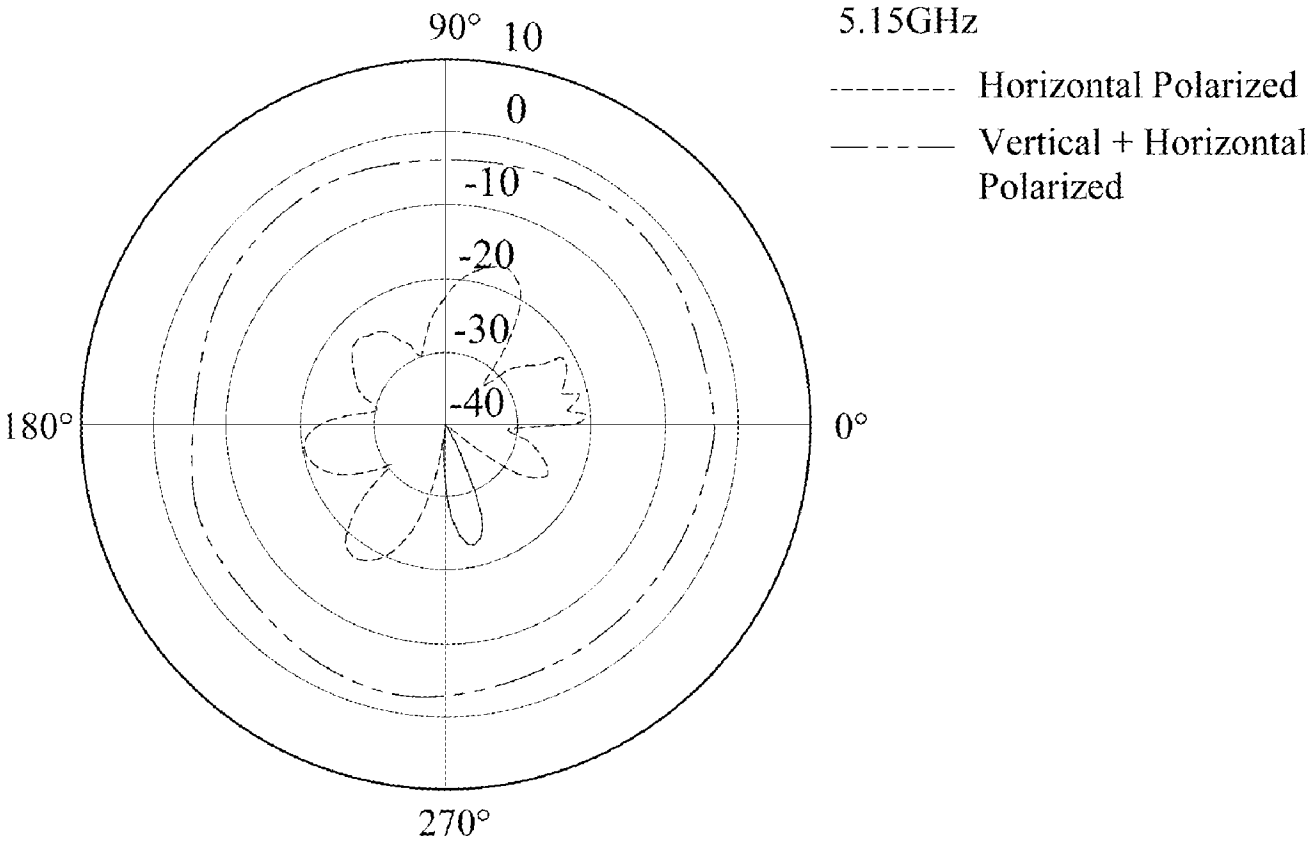
FIG. 3E shows the field pattern of a dual-band antenna unit at 5.15 GHz according to one embodiment of the present invention.
Figure 3F:
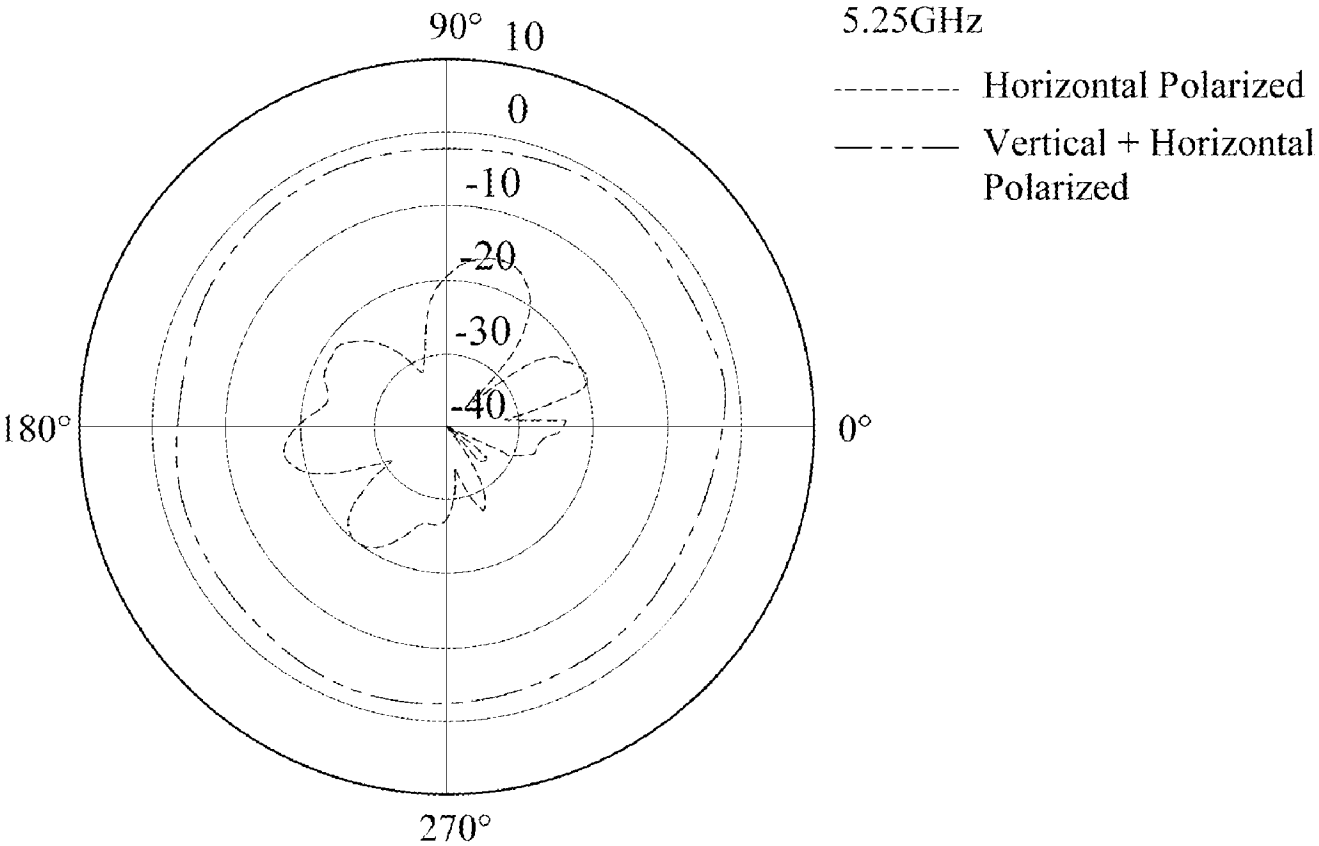
FIG. 3F shows the field pattern of a dual-band antenna unit at 5.25 GHz according to one embodiment of the present invention.
Figure 3G:
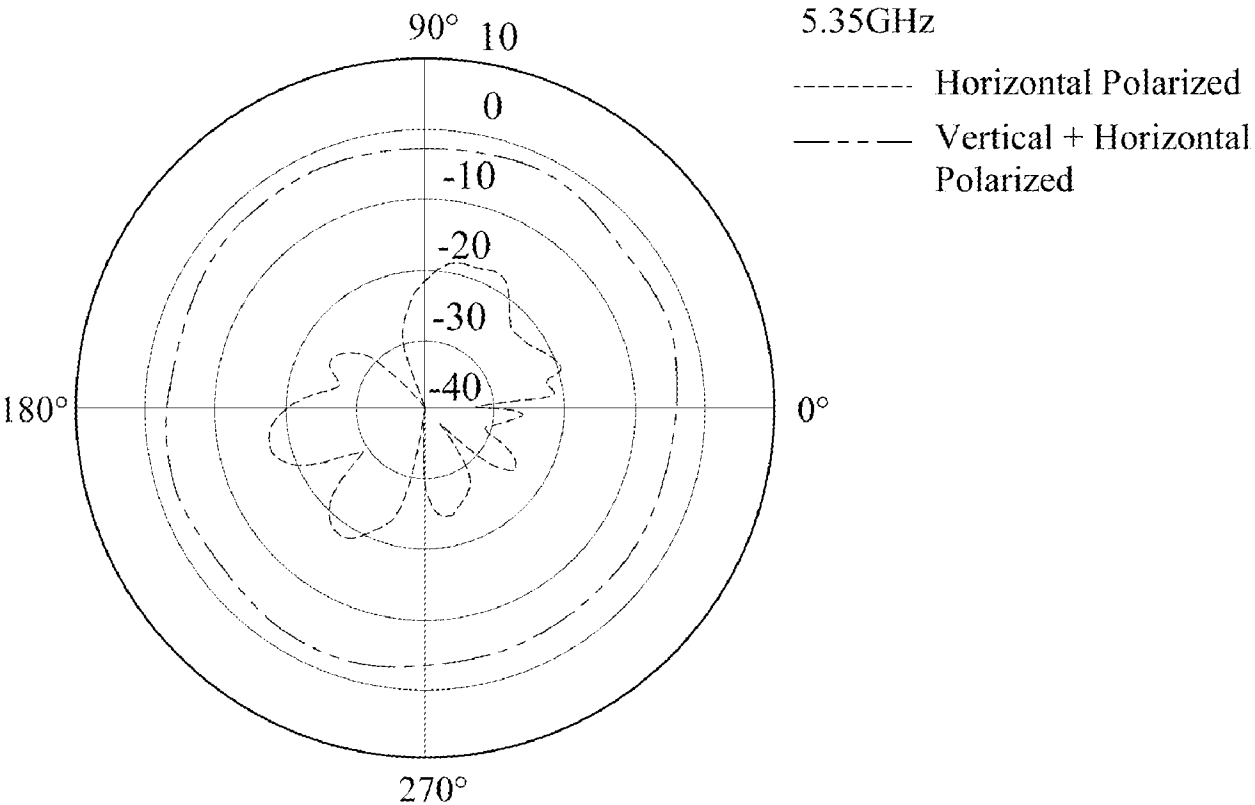
FIG. 3G shows the field pattern of a dual-band antenna unit at 5.35 GHz according to one embodiment of the present invention.
Figure 3H:
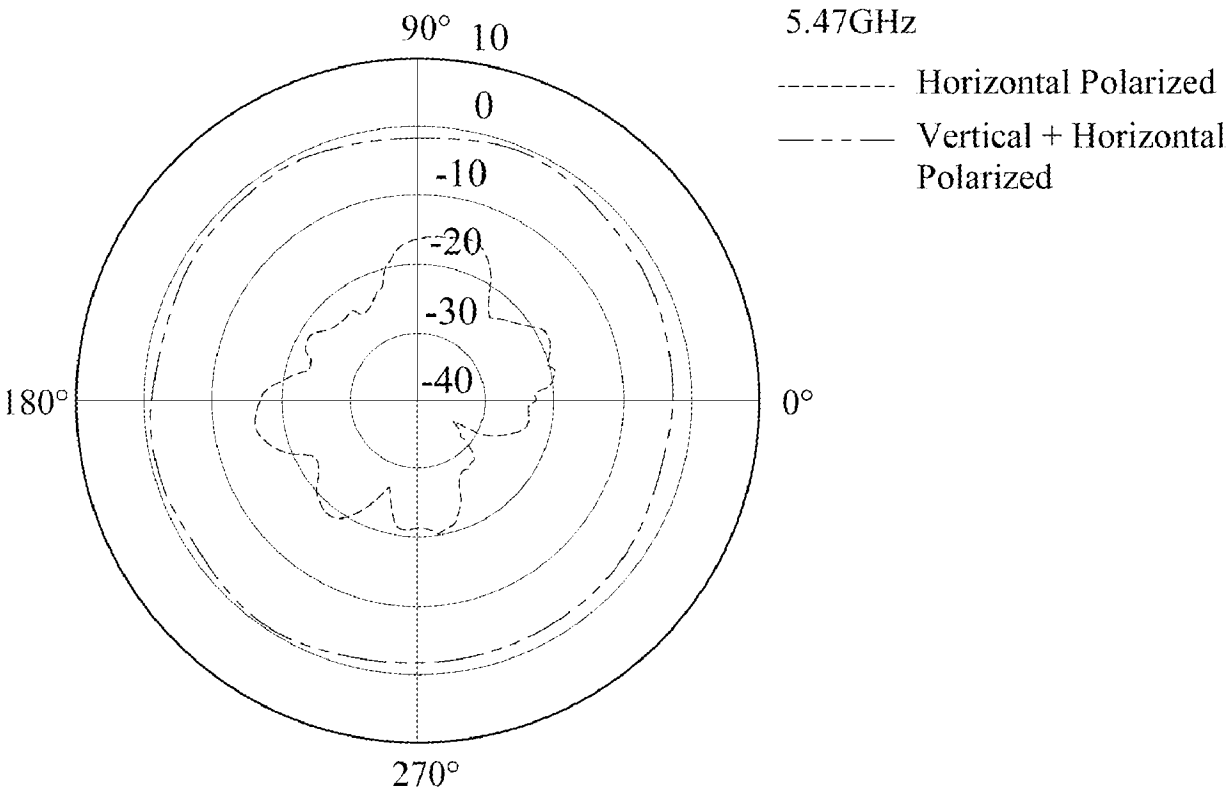
FIG. 3H shows the field pattern of a dual-band antenna unit at 5.47 GHz according to one embodiment of the present invention.
Figure 3I:
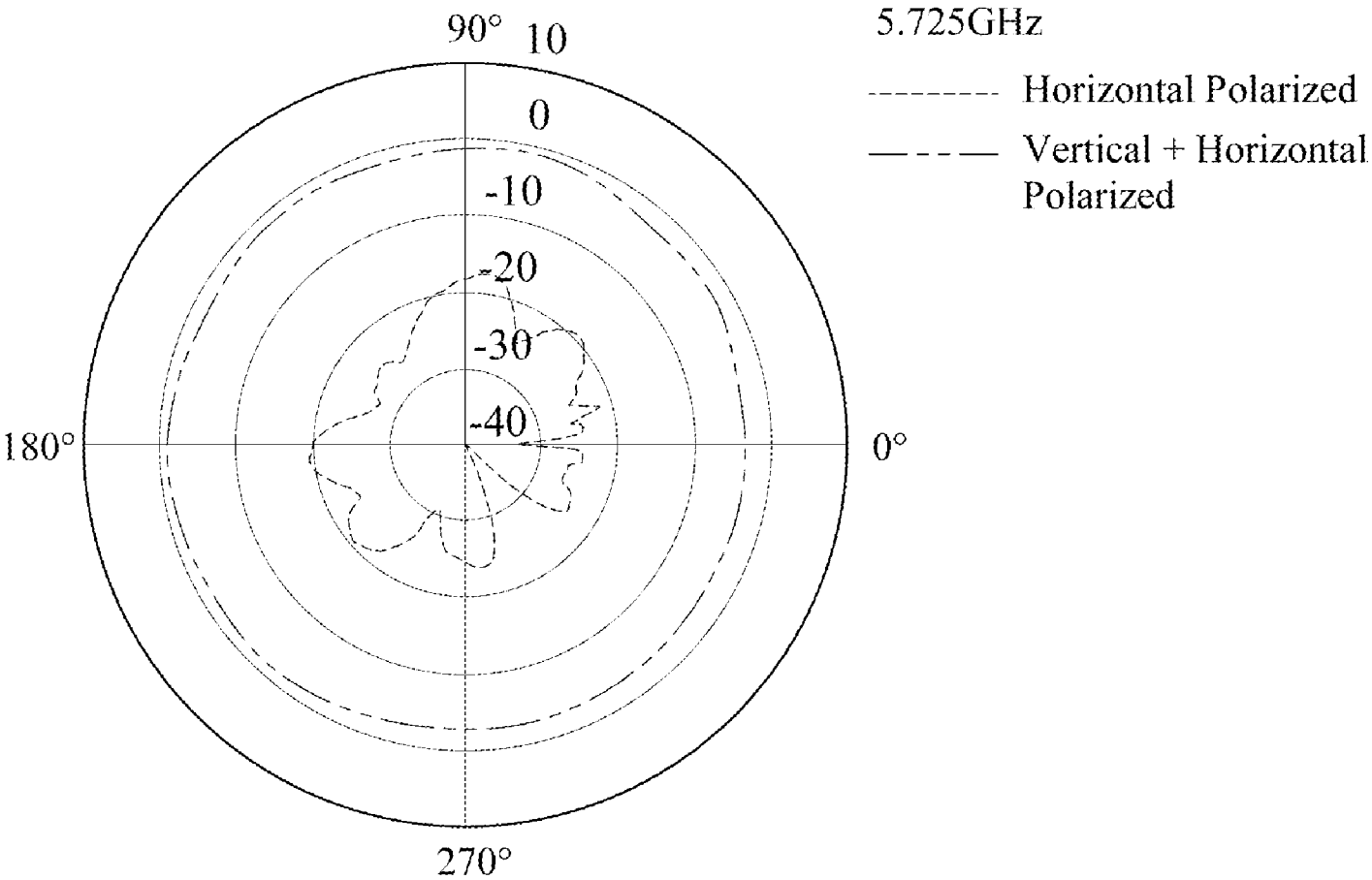
FIG. 3I shows the field pattern of a dual-band antenna unit at 5.725 GHz according to one embodiment of the present invention.
Figure 3J:
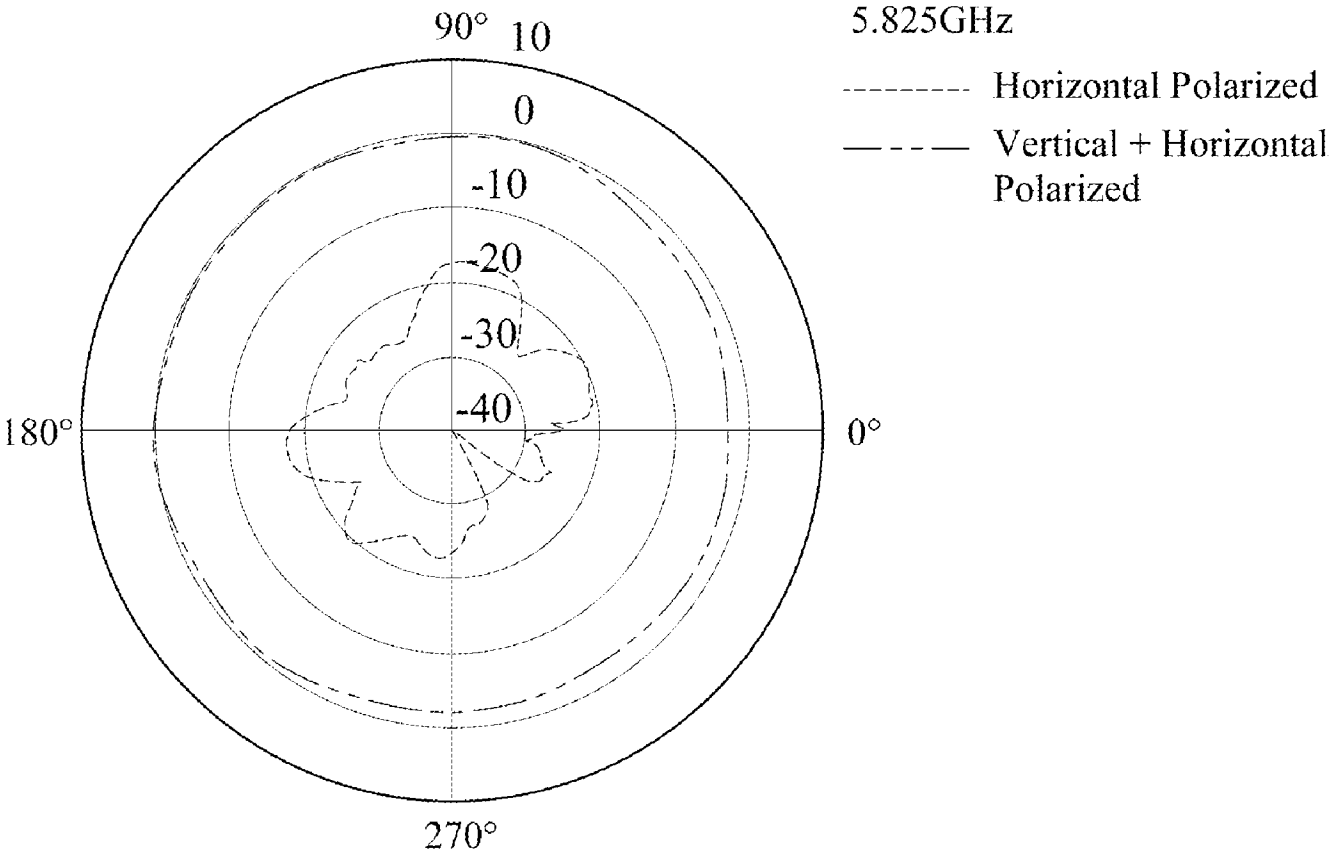
FIG. 3J shows the field pattern of a dual-band antenna unit at 5.825 GHz according to one embodiment of the present invention.
Figure 3K:
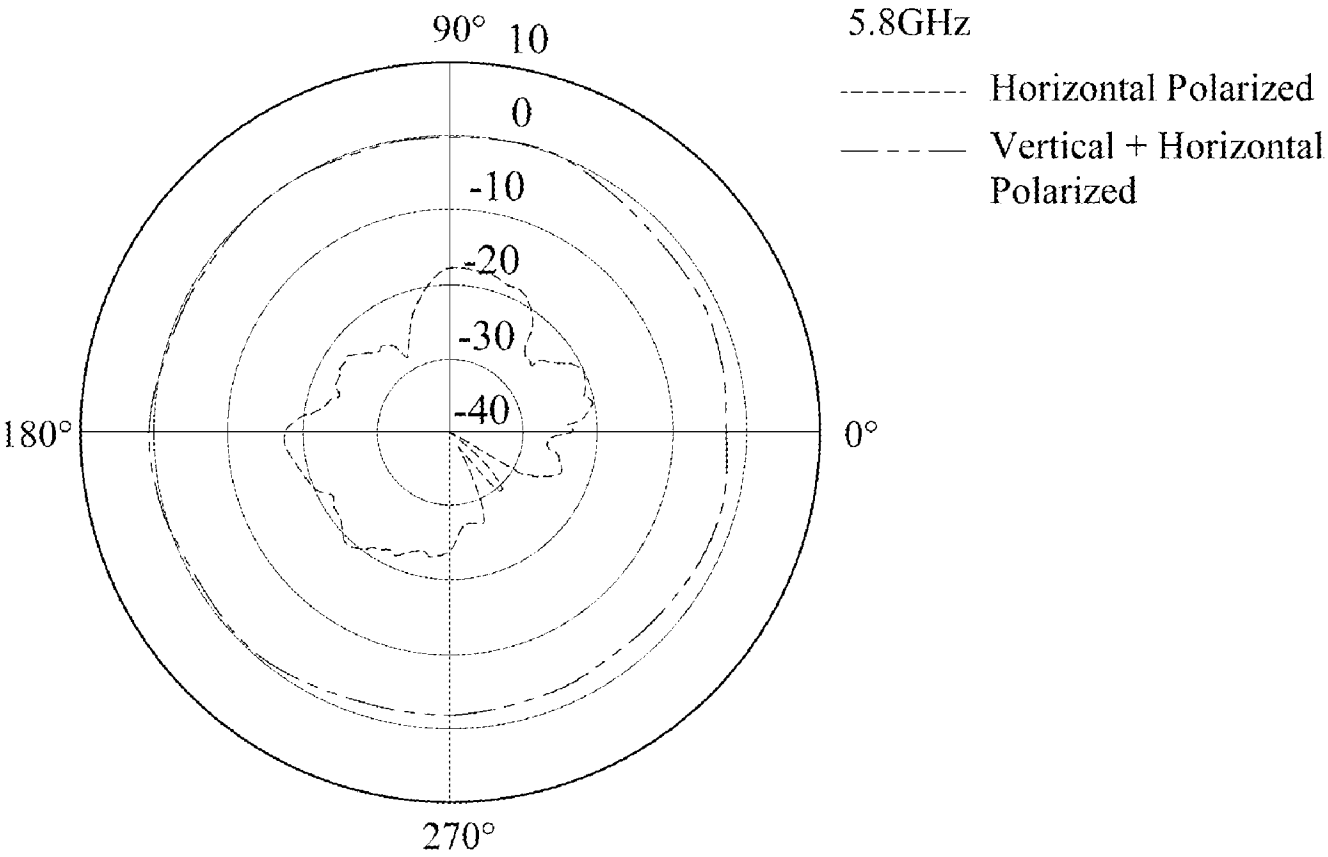
FIG. 3K shows the field pattern of a dual-band antenna unit at 5.85 GHz according to one embodiment of the present invention.
Figure 3L:
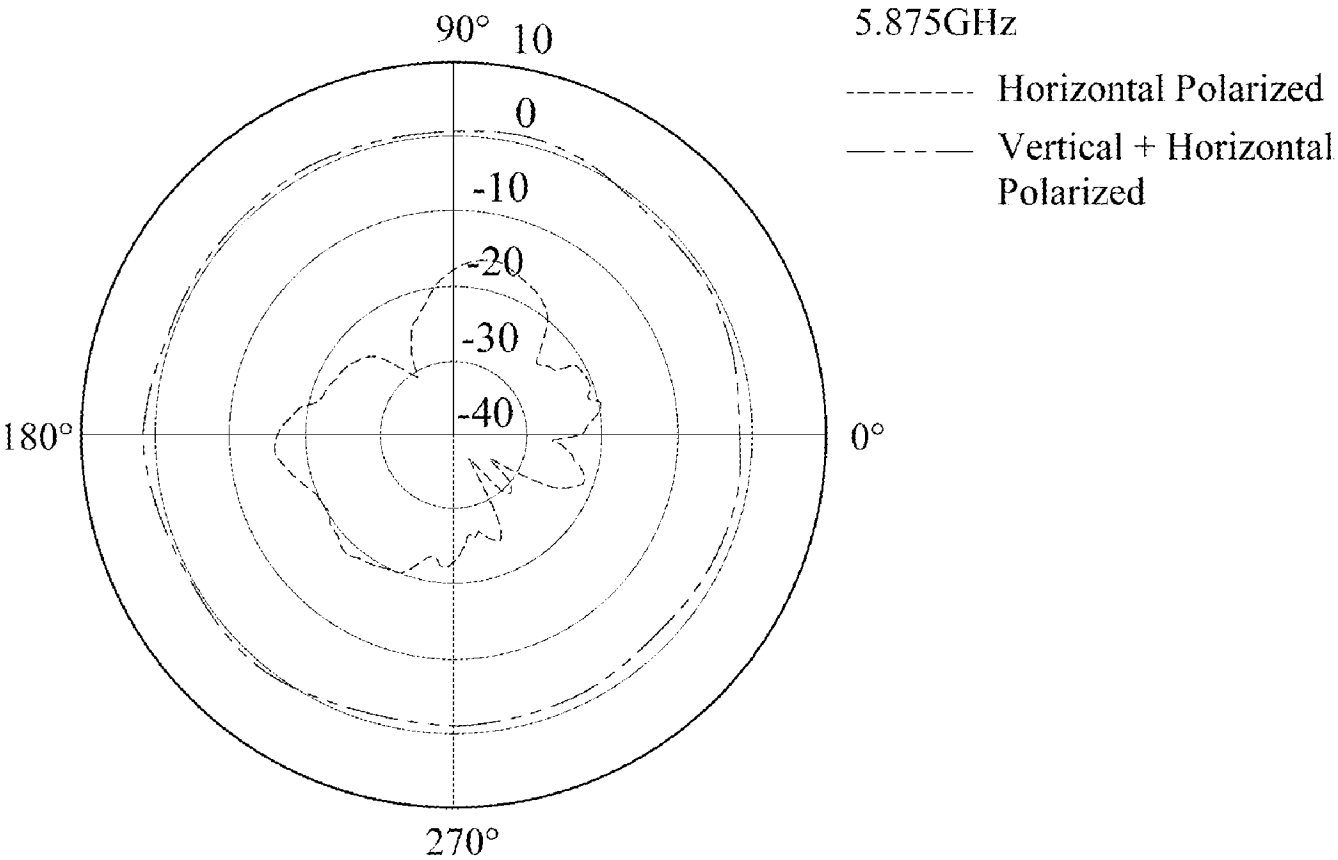
FIG. 3L shows the field pattern of a dual-band antenna unit at 5.875 GHz according to one embodiment of the present invention.

FIG. 2A to FIG. 2C show the relation of standing-wave ratio (SWR) to frequency according to one embodiment of the present invention. FIG. 3A to FIG. 3L show the field pattern of a dual-band antenna unit at 2.4 GHz to 5.875 GHz according to one embodiment of the present invention. Referring to FIG. 2A to FIG. 2C and FIG. 3A to FIG. 3L, in the working frequency range from 2.4 GHz to 2.5 GHz and 4.9 GHz to 5.875 GHz of currently available wireless products, it shows that the dual-band antenna unit of the present invention exhibits excellent transceiving performances. More importantly, the dual-band antenna unit of the present invention comprises a plurality of antennas with various frequency bands with excellent signal transmission quality so that the manufacturing cost can be reduced.

Figure 4A:
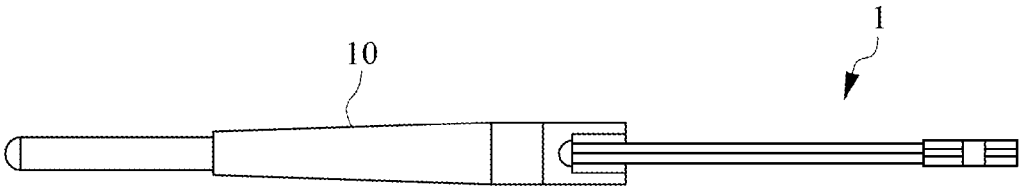
FIG. 4A is a front view of a dual-band antenna unit according to another embodiment of the present invention.
Figure 4B:
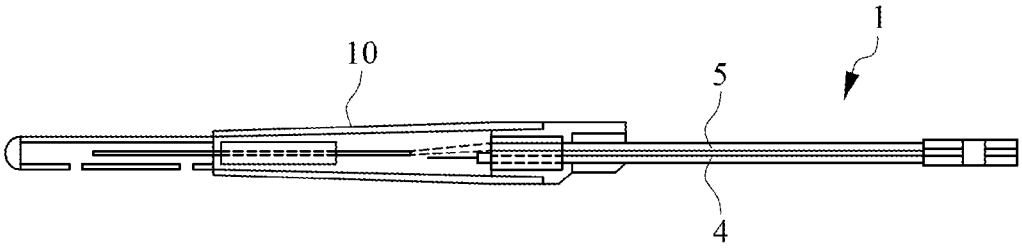
FIG. 4B is a perspective view of a dual-band antenna unit according to another embodiment of the present invention.
Figure 4C:
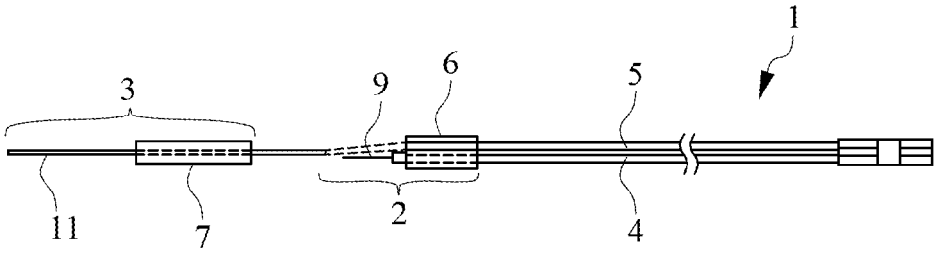
FIG. 4C is a structural view of a dual-band antenna unit according to another embodiment of the present invention.

FIG. 4A, FIG. 4B and FIG. 4C are respectively a front view, a perspective view and a structural view of a dual-band antenna unit according to another embodiment of the present invention. Referring to FIG. 4A, FIG. 4B and FIG. 4C, the present invention provides a dual-band antenna unit 1, comprising: a first radiation unit 2 comprising a first metal tube 6 and a first metal wire 9 electrically connected in series; a second radiation unit 3 comprising a second metal tube 7 and a second metal wire 11 electrically connected in series; a first signal feed-in unit 4 comprising a first feed-in unit and a first grounding unit, the first grounding unit being electrically connected to the first metal tube 6 and the first feed-in unit being electrically connected to the first metal wire 9; and a second signal feed-in unit 5 comprising a second feed-in unit and a second grounding unit, the second grounding unit being electrically connected to the second metal tube 7 and the second feed-in unit being electrically connected to the second metal wire 11; wherein the first radiation unit 2, the second radiation unit 3, the first signal feed-in unit 4 and the second signal feed-in unit 5 are disposed in the dual-band antenna unit 1.

According to the present embodiment, the first metal wire 9 is extended from the first feed-in unit and the second metal wire 11 is extended from the second feed-in unit. Preferably, the first signal feed-in unit 4 and the second signal feed-in unit 5 are co-axial wires. Generally, to avoid interference from external signals, the dual-band antenna unit 1 further comprises a housing 10 so that the first radiation unit 2, the second radiation unit 3, the first signal feed-in unit 4 and the second signal feed-in unit 5 are disposed in the dual-band antenna unit 1. In this manner, the performance of the dual-band antenna unit 1 is improved. Preferably, the first radiation unit 2 and the second radiation unit 3 are arranged in series in the housing 10. The housing 10 is made of non-conductive materials such as plastic capable of protecting the radiation units. To fixedly install the elements in the dual-band antenna unit 1, a plastic coating can be provided to cover the first radiation unit 2 and the second radiation unit 3. The materials for making the first metal tube 6, the second metal tube 7, the first metal wire 9 and the second metal wire 11 are not limited to the examples in the present embodiment. Generally, these elements can be made of copper.

Figure 5A:
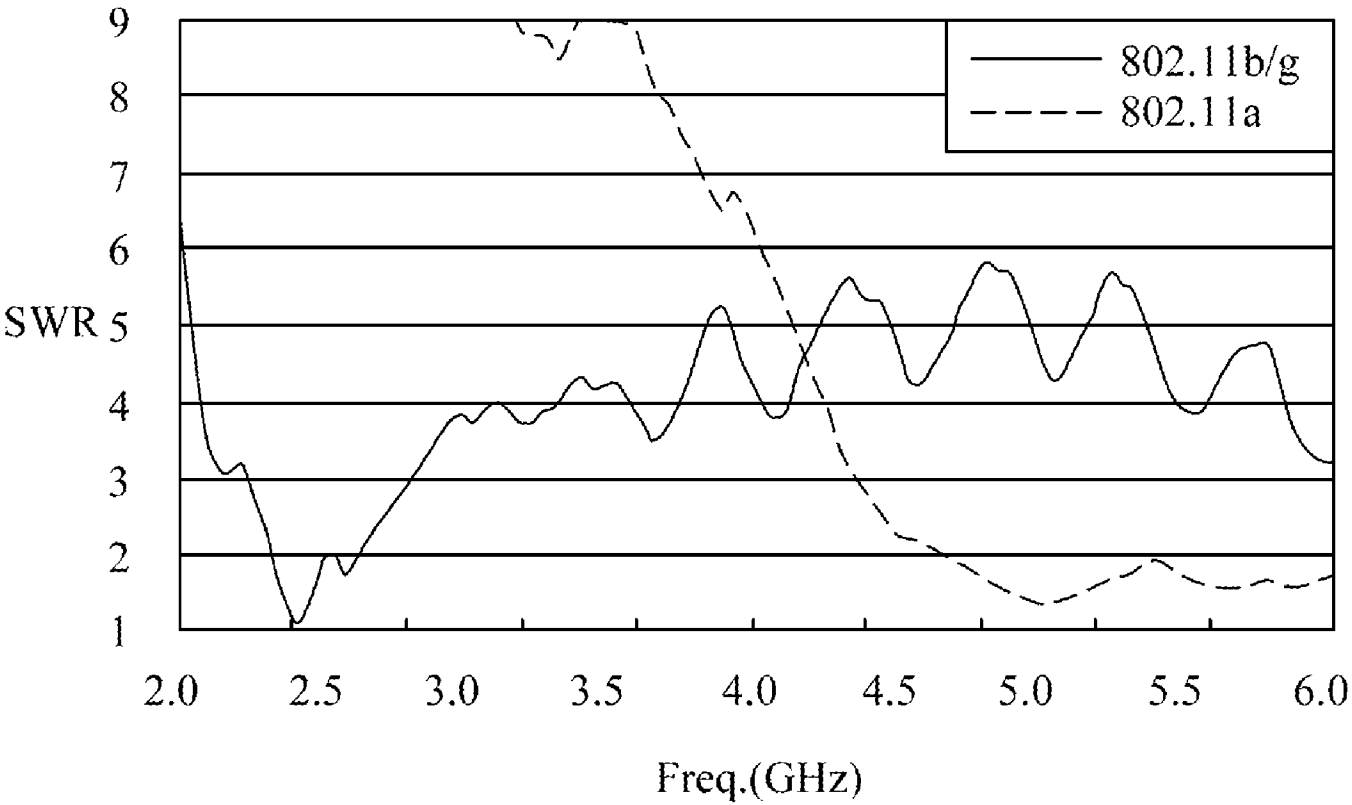
FIG. 5A shows the relation of standing-wave ratio (SWR) to frequency according to another embodiment of the present invention.
Figure 5B:
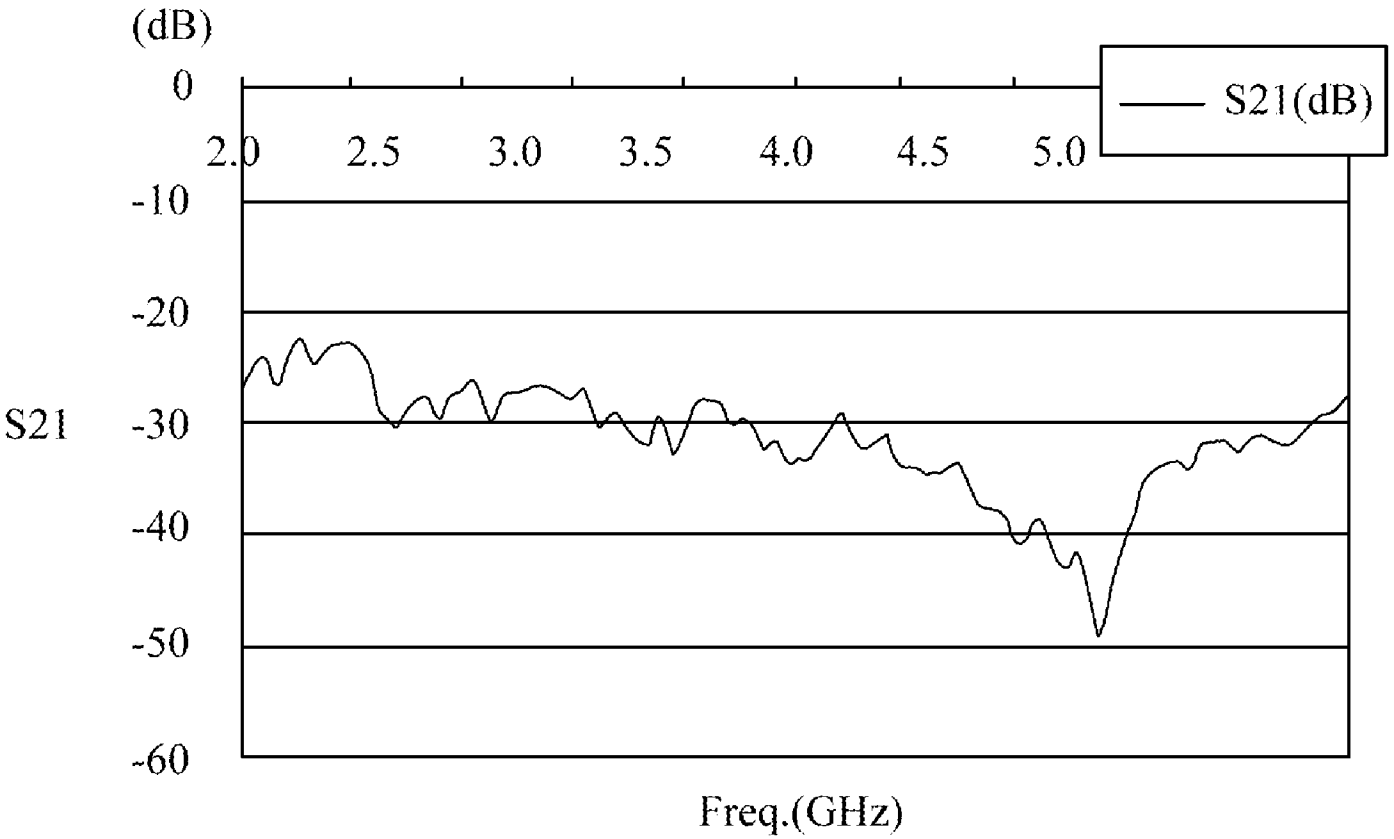
FIG. 5B shows the relation of S21 to frequency according to another embodiment of the present invention.
Figure 6A:
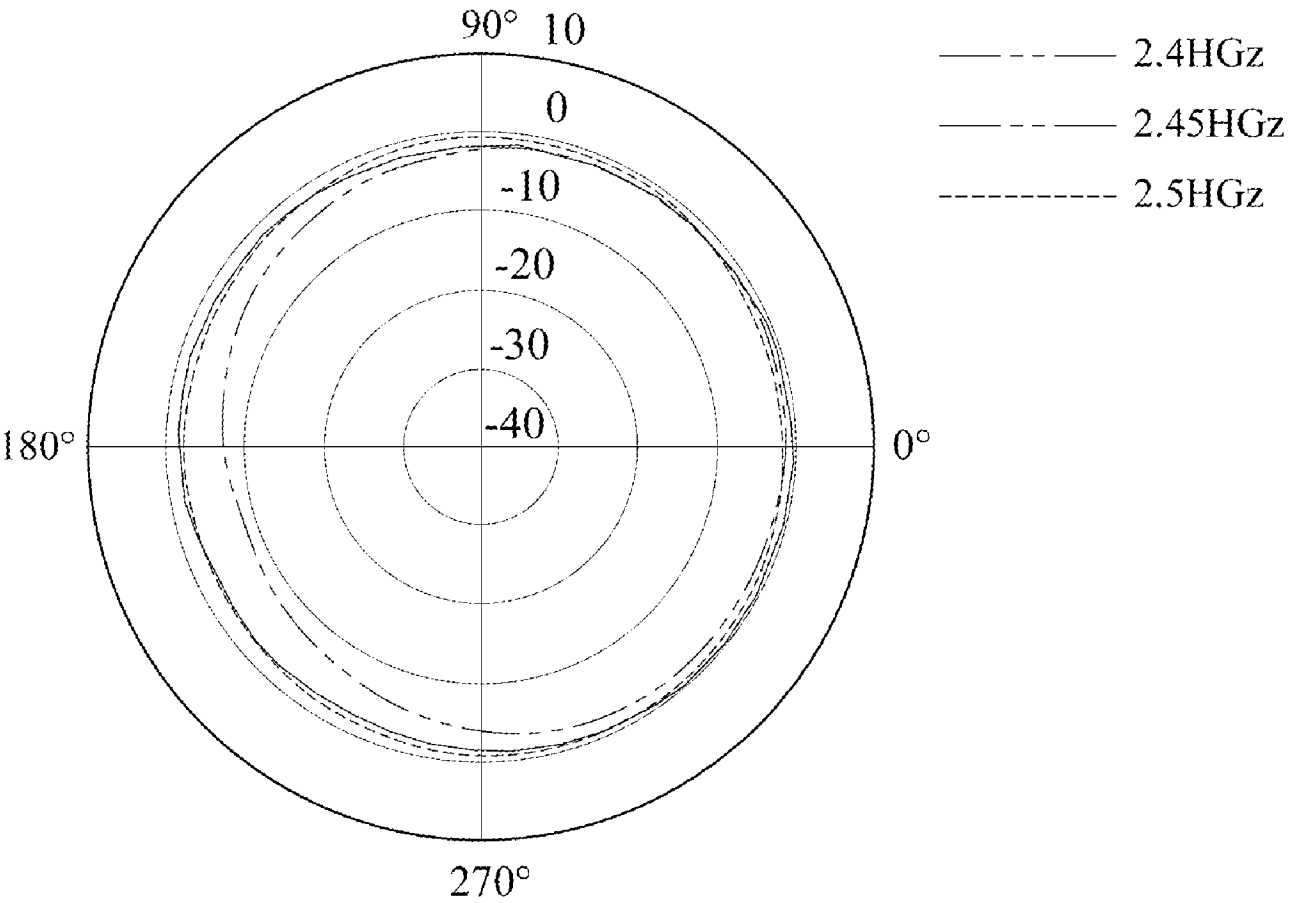
FIG. 6A shows the field pattern of a dual-band antenna unit at 2.4 GHz to 2.5 GHz according to another embodiment of the present invention.
Figure 6B:
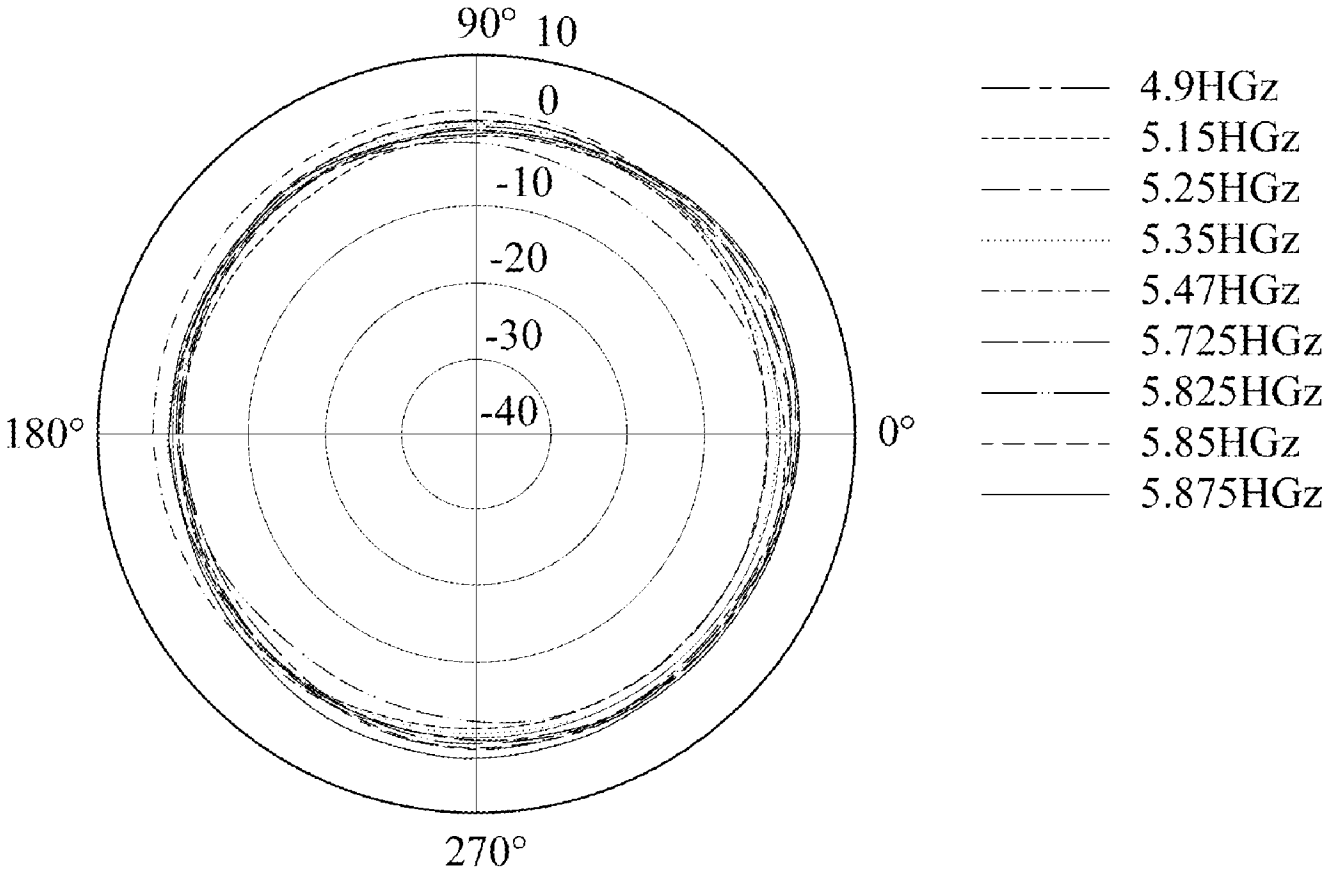
FIG. 6B shows the field pattern of a dual-band antenna unit at 4.9 Ghz to 5.875 GHz according to another embodiment of the present invention.

FIG. 5A and FIG. 5C show the relation of standing-wave ratio (SWR) to frequency according to another embodiment of the present invention. FIG. 6A and FIG. 6B show the field pattern of a dual-band antenna unit at 2.4 GHz to 5.875 GHz according to another embodiment of the present invention. Referring to FIG. 5A, FIG. 5B, FIG. 6A and FIG. 6B, in the working frequency range from 2.4 GHz to 2.5 GHz and 4.9 GHz to 5.875 GHz of currently available wireless products, it shows that the dual-band antenna unit of the present invention exhibits excellent transceiving performances. More importantly, the dual-band antenna unit of the present invention comprises a plurality of antennas with various frequency bands with excellent signal transmission quality so that the manufacturing cost can be reduced.

Accordingly, the present invention provides a dual-band antenna unit so that the number of antennas can be reduced to achieve lower cost while remaining the signal transmission quality. Therefore, the present invention is novel, useful and non-obvious.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A dual-band antenna unit, comprising:

a first radiation unit comprising a first metal tube and a second metal tube electrically connected in series;

a second radiation unit comprising a third metal tube and a first metal wire electrically connected in series;

a first signal feed-in unit comprising a first feed-in unit and a first grounding unit, the first grounding unit being electrically connected to the first metal tube and the first feed-in unit being electrically connected to the second metal tube; and a second signal feed-in unit comprising a second feed-in unit and a second grounding unit, the second grounding unit being electrically connected to the third metal tube and the second feed-in unit being electrically connected to the first metal wire;

wherein the first radiation unit, the second radiation unit, the first signal feed-in unit and the second signal feed-in unit are disposed in the dual-band antenna unit.

2. The dual-band antenna unit as recited in claim 1, wherein the first metal wire is extended from the second feed-in unit.

3. The dual-band antenna unit as recited in claim 1, wherein the first signal feed-in unit and the second signal feed-in unit are co-axial wires.

4. The dual-band antenna unit as recited in claim 1, further comprising a housing so that the first radiation unit, the second radiation unit, the first signal feed-in unit and the second signal feed-in unit are disposed in the dual-band antenna unit.

5. The dual-band antenna unit as recited in claim 4, wherein the first radiation unit and the second radiation unit are arranged in series in the housing.

6. The dual-band antenna unit as recited in claim 4, wherein the housing is made of plastic.

7. The dual-band antenna unit as recited in claim 1, wherein the first metal tube, the second metal tube and the third metal tube are copper tubes.

8. The dual-band antenna unit as recited in claim 1, wherein the first metal wire is a copper wire.

9. A dual-band antenna unit, comprising:

a first radiation unit comprising a first metal tube and a first metal wire electrically connected in series;

a second radiation unit comprising a second metal tube and a second metal wire electrically connected in series;

a first signal feed-in unit comprising a first feed-in unit and a first grounding unit, the first grounding unit being electrically connected to the first metal tube and the first feed-in unit being electrically connected to the first metal wire; and a second signal feed-in unit comprising a second feed-in unit and a second grounding unit, the second grounding unit being electrically connected to the second metal tube and the second feed-in unit being electrically connected to the second metal wire;

wherein the first radiation unit, the second radiation unit, the first signal feed-in unit and the second signal feed-in unit are disposed in the dual-band antenna unit.

10. The dual-band antenna unit as recited in claim 9, wherein the first metal wire is extended from the first feed-in unit.

11. The dual-band antenna unit as recited in claim 9, wherein the second metal wire is extended from the second feed-in unit.

12. The dual-band antenna unit as recited in claim 9, wherein the first signal feed-in unit and the second signal feed-in unit are co-axial wires.

13. The dual-band antenna unit as recited in claim 9, further comprising a housing so that the first radiation unit, the second radiation unit, the first signal feed-in unit and the second signal feed-in unit are disposed in the dual-band antenna unit.

14. The dual-band antenna unit as recited in claim 13, wherein the first radiation unit and the second radiation unit are arranged in series in the housing.

15. The dual-band antenna unit as recited in claim 13, wherein the housing is made of plastic.

16. The dual-band antenna unit as recited in claim 9, wherein the first metal tube and the second metal tube are copper tubes.

17. The dual-band antenna unit as recited in claim 9, wherein the first metal wire and the second metal wire are copper wires.

* * * * *